US010844744B2

(12) United States Patent
Wilkes

(10) Patent No.: US 10,844,744 B2
(45) Date of Patent: Nov. 24, 2020

(54) DOUBLE WALL SUPERCRITICAL CARBON DIOXIDE TURBOEXPANDER

(71) Applicant: Southwest Research Institute, San Antonio, TX (US)

(72) Inventor: Jason C. Wilkes, Fair Oaks Ranch, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 15/694,614

(22) Filed: Sep. 1, 2017

(65) Prior Publication Data

US 2019/0071995 A1 Mar. 7, 2019

(51) Int. Cl.
*F01D 25/14* (2006.01)
*F01K 25/10* (2006.01)
(Continued)

(52) U.S. Cl.
CPC ..... *F01D 25/145* (2013.01); *F01D 25/12* (2013.01); *F01D 25/14* (2013.01); *F01D 25/26* (2013.01);
(Continued)

(58) Field of Classification Search
CPC ..... F01K 7/32; F01K 25/10; F01K 25/103; F01D 25/12; F01D 25/14; F01D 25/145;
(Continued)

(56) References Cited

U.S. PATENT DOCUMENTS 2,823,890 A * 2/1958 Oechslin ..... F01D 25/145 415/136
4,166,878 A 9/1979 Thompson et al.
(Continued)

FOREIGN PATENT DOCUMENTS

AT 381367 B * 10/1986 ..... F01D 25/12
DE 102009007734 A1 * 8/2010 ..... F01D 9/026
(Continued)

OTHER PUBLICATIONS

Anderson, K.R., et al: "Waste Heat Energy Supercritical Carbon Dioxide Recovery Cycle Analysis and Design"; Avestia Publishing, Advances in Renewable Energy, vol. 1, Issue 1, 2014 (10 pgs).
(Continued)

*Primary Examiner* — Laert Dounis
(74) *Attorney, Agent, or Firm* — Grossman Tucker Perreault & Pfleger PLLC

(57) ABSTRACT

The present disclosure is directed to systems and methods generating power using supercritical $CO_2$ in a Brayton cycle that incorporates a double-wall turboexpander that includes an inner chamber housing the turbine and an outer chamber that includes a thermal attenuator that reduces the outer chamber wall temperature of the turboexpander. An inner chamber wall separates the inner chamber and the outer chamber within the double-wall turboexpander. In supercritical $CO_2$ applications, the double-wall turboexpander operates at elevated temperatures and elevated pressures. By maintaining the thermal attenuator the outer chamber at an elevated pressure, the differential pressure across the inner chamber wall is reduced, requiring less high-temperature alloy material in the construction of the double-wall turboexpander when compared to a conventional turboexpander. By reducing the operating temperature of the outer chamber wall, a less costly lower-temperature alloy may be used to provide structural strength to the double-wall turboexpander.

20 Claims, 9 Drawing Sheets

(51) Int. Cl.
*F01D 25/12* (2006.01)
*F01D 25/26* (2006.01)

(52) U.S. Cl.
CPC ..... *F01K 25/103* (2013.01); *F05D 2220/76* (2013.01); *F05D 2240/14* (2013.01); *F05D 2260/221* (2013.01)

(58) Field of Classification Search
CPC ..... F01D 25/24; F01D 25/26; F01D 25/265; F02C 7/12; F02C 7/125
USPC ..... 60/647, 782, 806
See application file for complete search history.

(56) References Cited

U.S. PATENT DOCUMENTS 4,300,349 A 11/1981 Heckel
4,498,301 A * 2/1985 Tsubouchi ..... F01D 25/14 415/175
4,534,700 A * 8/1985 Horler ..... F01D 25/145 415/135
6,099,931 A 8/2000 Heller et al.
6,315,520 B1 * 11/2001 Haje ..... B22C 9/10 415/178
6,877,340 B2 4/2005 Hiwata et al.
8,893,499 B2 11/2014 Maier
2010/0034641 A1 * 2/2010 Ikeda ..... F01D 25/14 415/116
2012/0067054 A1 * 3/2012 Palmer ..... F01D 5/085 60/772
2013/0033044 A1 * 2/2013 Wright ..... F02C 9/00 290/1 R
2013/0177389 A1 * 7/2013 Maier ..... F04D 3/00 415/1
2014/0023478 A1 * 1/2014 Maeda ..... F01D 3/04 415/1
2017/0254225 A1 * 9/2017 Kim ..... F01K 11/02
2018/0245481 A1 * 8/2018 Hossbach ..... F01D 25/243

FOREIGN PATENT DOCUMENTS

GB 901896 A * 7/1962 ..... F01D 25/145
WO WO-2011039050 A2 * 4/2011 ..... F01D 25/145

OTHER PUBLICATIONS

Brun, Dr.K.: "Supercritical Carbon Dioxide Turbo-Expander and Heat Exchangers"; SunShot U.S. DOE, Concentrating Solar Power, Sep. 2012; <<https://energy.gov/sites/prod/files/2014/01/t7/55462.pdf>> (accessed May 22, 2017) 1 pg.

* cited by examiner

DOUBLE WALL SUPERCRITICAL CARBON DIOXIDE TURBOEXPANDER

TECHNICAL FIELD

The present disclosure relates to supercritical carbon dioxide process equipment.

BACKGROUND

Supercritical carbon dioxide is an emerging technology for improved power cycle efficiency in the United States and around the world. The physical properties of carbon dioxide and the dynamics of the energy generation cycle result in a combination of high operating temperature and high operating pressure in the turbine section of the turbomachinery used to generate shaft work as a process output. The combination of high temperature and high pressure causes system designers to choose materials demonstrating adequate safety margin when operating at temperatures in excess of 600° C. and at pressures in excess of 200 atmospheres.

The force exerted by internal pressure within process equipment is proportional to the pressure and the overall surface area exposed to the pressure. In applications at extreme pressures (e.g., 3000 pounds per square inch (psi) to 4000 psi) significant forces may be generated. The equipment housing must be capable of withstanding such forces while still providing an adequate margin of safety. Such large forces generate stresses within equipment housings requiring the use of high-strength materials. If the high strength materials are additionally subjected to high temperatures, the strength of the material may be reduced by as much as 80%-90% when compared to the strength of the material at room temperatures. The reduction in strength attributable to high temperature operation further increases the thickness of the housing to provide an adequate margin of safety. Increasing the thickness of the equipment housing to handle the increased operating temperatures and pressures creates additional issues with stress induced by thermal gradients and/or transients in the material and may result in low-cycle thermal fatigue if not properly addressed during equipment design and construction. Typically such designs specify a high temperature alloy that may have a significant cost and may be difficult to cast, machine, or otherwise fabricate.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
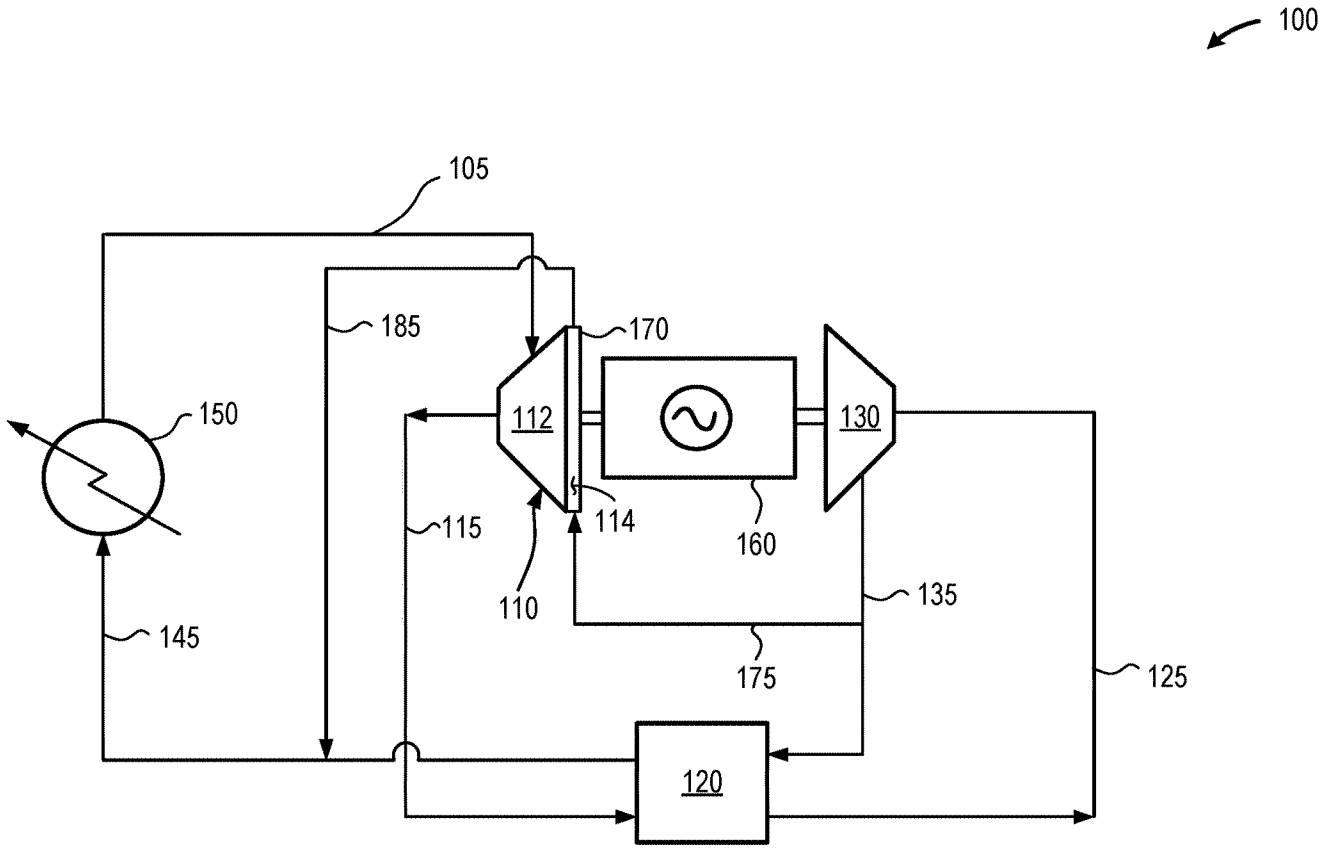
FIG. 1 is a simplified process flow diagram of an illustrative energy generation process to generate electricity using supercritical $CO_2$ that is passed through a double-wall turboexpander to provide a shaft input to a supercritical $CO_2$ compressor and/or electrical generator, in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

The systems and methods disclosed herein provide for an equipment design featuring a lining or interior partition to isolate the high temperature/high pressure process fluid from the external casing of the equipment. The systems and methods disclosed herein provide process equipment having an inner chamber to handle the high temperature/high pressure process fluid. The inner chamber is at least partially surrounded by an outer chamber containing a coolant at an elevated pressure or an insulation barrier at an elevated pressure. Although the equipment walls forming the inner chamber are exposed to relatively high process temperatures, the presence of the high pressure coolant on the opposite side of the wall forming the inner chamber limits the differential pressure seen by the wall forming the inner chamber. This reduced differential pressure permits the use of a thinner wall to form the inner chamber than if the relatively high pressure coolant were not present in the outer chamber. The ability to use a thinner wall to form the inner chamber beneficially and advantageously reduces the quantity of high-temperature alloy material used in fabrication of the equipment.

The presence of the coolant or the insulation barrier in the outer chamber reduces the temperature to which the outer walls of the equipment are exposed. Thus, although the outer walls of the equipment may be exposed to relatively high pressures (i.e., the pressure of the coolant or submersed insulation barrier in the outer chamber) such exposure is at a lower temperature than the temperature of the process fluid in the inner chamber. This reduced temperature permits the use of relatively lower cost materials to form the external or outer walls of the equipment, beneficially and advantageously reducing or even eliminating the need for high-temperature alloy material in forming and/or fabricating the external or outer surfaces of the equipment.

The inner chamber wall physically couples to the outer chamber wall at a limited number of locations to account for the differential thermal expansion that may occur during equipment operation. For example, in some embodiments, the inner chamber wall may physically couple to the outer chamber wall at one or more points about the perimeter of the inner chamber wall. Such construction may accommodate the differential thermal expansion between a first material (e.g., relatively higher cost high temperature/low differential pressure alloy) used to fabricate the inner chamber wall and a second material (e.g., relatively lower cost lower temperature/higher differential pressure alloy) used to fabricate the outer chamber wall/equipment housing. Various flow enhancement surface features (e.g., channels, bumps, vanes, grooves, and similar) may be disposed, cast or otherwise formed within the inner chamber to both: improve heat transfer of the supercritical carbon dioxide ($CO_2$) through the inner chamber wall; and enhance the flow of supercritical $CO_2$ through the inner chamber.

Similarly, various flow enhancement surface features (e.g., channels, bumps, vanes, grooves, and similar) may be disposed, cast or otherwise formed within the outer chamber to both: improve heat transfer between the supercritical $CO_2$ and the coolant; and improve the flow of coolant through the outer chamber. The systems and methods described herein provide non-trivial improvements in process equipment used in high pressure and high temperature processes. An example of such a process is a power cycle using supercritical carbon dioxide ($CO_2$). In such a process, pressures may reach in excess of 200 atmospheres and temperatures may reach in excess of 700° Centigrade.

A double-wall turboexpander is provided. The double-wall turboexpander may include: an expansion turbine disposed in a continuous, fluid-tight, inner chamber. The inner chamber to: receive supercritical $CO_2$ at a first temperature and a first pressure and discharge supercritical $CO_2$ at a second temperature and a second pressure, the second temperature less than the first temperature, the second pressure less than the first pressure. The double-wall turboexpander may also include: an inner chamber wall forming at least a portion of the perimeter of the continuous, fluid-tight, inner chamber; wherein the inner chamber wall includes a first material having a first thickness selected based, at least in part, on the first temperature; an outer chamber wall spaced apart from the inner chamber wall to form a continuous, fluid-tight, outer chamber between the inner chamber wall and the outer chamber wall of the double-wall turboexpander, the outer chamber to: and receive thermal attenuator at a third pressure that is less than the first pressure, the thermal attenuator to maintain the outer chamber wall at a third temperature that is less than the first temperature. The outer chamber wall includes a second material having a second thickness selected, based at least in part, on the third temperature.

A method for expanding supercritical CO2 to produce shaft work is provided. The method may include: flowing supercritical $CO_2$ at a first temperature and a first pressure through a continuous, fluid-tight, inner chamber that includes a supercritical $CO_2$ expansion turbine; removing the expanded supercritical $CO_2$ at a second temperature and a second pressure from the inner-chamber; wherein the second temperature is less than the first temperature; and wherein the second pressure is less than the first pressure. The method may also include, contemporaneous with flowing the supercritical $CO_2$ at the first temperature and the first pressure through the inner chamber, attenuating at least a portion of the thermal energy from the supercritical CO2 sufficient to maintain an outer chamber wall of a continuous, fluid-tight, outer chamber at a third temperature; wherein the third temperature is less than the first temperature; and wherein at least a portion of the inner chamber and at least portion of the outer chamber are formed by opposite sides of an inner chamber wall that includes a first material having a first thickness selected based, at least in part, on the first temperature; and wherein the outer chamber includes an outer chamber wall that includes a second material having a second thickness selected based, at least in part, on the third temperature.

A supercritical $CO_2$-based energy generation system is provided. The system may include: a heat source to provide supercritical $CO_2$ at a first temperature and a first pressure; a double walled supercritical $CO_2$ turboexpander that includes: an inner chamber that includes a supercritical $CO_2$ expansion turbine, the inner chamber to receive the supercritical $CO_2$ at the first temperature and the first pressure and discharge the supercritical $CO_2$ at a second temperature and a second pressure. The system may additionally include: an outer chamber at least partially surrounding the inner chamber, the outer chamber to receive a thermal attenuator sufficient to maintain an outer chamber wall at a third temperature; wherein an inner chamber wall having a first thickness fluidly isolates the inner chamber and the outer chamber; wherein an outer chamber wall having a second thickness fluidly isolates the outer chamber from an ambient environment about the turboexpander. The system may further include a thermal energy exchanger fluidly coupled to the inner chamber to receive supercritical $CO_2$ at the second temperature and the second pressure and cool the supercritical $CO_2$; a supercritical $CO_2$ compressor fluidly coupled to the thermal recovery system to receive the cooled supercritical $CO_2$, the supercritical $CO_2$ compressor to provide compressed supercritical $CO_2$ at an elevated pressure; and an energy generator operably coupled to the double walled supercritical $CO_2$ turboexpander to receive a shaft work input from the double walled supercritical $CO_2$ turboexpander.

A double-wall supercritical $CO_2$ turboexpander is provided. The double-wall supercritical $CO_2$ turboexpander may include: an expansion turbine disposed in a continuous, fluid-tight, inner chamber; a supercritical $CO_2$ inlet fluidly coupled to the inner chamber, the supercritical $CO_2$ inlet to receive supercritical $CO_2$ at a first temperature and a first pressure; a supercritical $CO_2$ outlet fluidly coupled to the inner chamber, the supercritical $CO_2$ outlet to discharge supercritical $CO_2$ at a second temperature and a second pressure, the second temperature less than the first temperature, the second pressure less than the first pressure; an inner chamber wall forming at least a portion of the perimeter of the inner chamber; wherein the inner chamber wall includes a first material composition having a first thickness, the first material composition and thickness selected based, at least in part, on the first pressure and the first temperature; an outer chamber wall spaced apart from the inner chamber wall to form a continuous, fluid-tight, outer chamber between the inner chamber wall and the outer chamber wall of the double-wall turboexpander; the outer chamber to receive a thermal attenuator sufficient, during operation, to maintain the outer chamber wall below a third temperature that is less than the first temperature and at a third pressure that is less than the second pressure; wherein the outer chamber wall includes a second material composition having a second thickness, the second material composition different from the first material composition, the second material suitable for use at the third temperature and the third pressure.

A double-wall supercritical $CO_2$ turboexpander is provided. The double-wall supercritical $CO_2$ turboexpander may include: an inner chamber housing an expansion turbine, the inner chamber to receive the supercritical $CO_2$ at the first temperature and the first pressure and discharge the supercritical $CO_2$ at a second temperature and a second pressure; and an outer chamber at least partially surrounding the inner chamber, the outer chamber to receive a thermal attenuator at a third temperature that is less than the first temperature and a third pressure that is less than the second pressure; wherein an inner chamber wall having a first thickness fluidly isolates the inner chamber and the outer chamber; and wherein an outer chamber wall having a second thickness fluidly isolates the outer chamber from an ambient environment about the double-wall turboexpander.

As used herein the terms "top," "bottom," "lowermost," and "uppermost" when used in relationship to one or more elements are intended to convey a relative rather than absolute physical configuration. Thus, an element described as an "uppermost element" or a "top element" in a device may instead form the "lowermost element" or "bottom element" in the device when the device is inverted. Similarly, an element described as the "lowermost element" or "bottom element" in the device may instead form the "uppermost element" or "top element" in the device when the device is inverted.

As used herein, the term "thermal attenuator" is intended to broadly cover any number and/or combination of materials, systems, and/or devices capable of attenuating at least a portion of the thermal energy flowing from the supercritical $CO_2$ in the inner chamber, through the inner chamber wall and into the outer chamber. Example thermal attenuators may include, but are not limited to, coolants that either flow through or remain static within the outer chamber and one or more flexible, semi-rigid, or rigid insulators.

FIG. 1 is a simplified process flow diagram of an illustrative energy generation process 100 to generate electricity using supercritical $CO_2$ that is passed through a double-wall turboexpander 110 to provide a shaft input to a supercritical $CO_2$ compressor 130 and/or electrical generator 160, in accordance with at least one embodiment described herein. As depicted in FIG. 1, a flow of high temperature/high pressure supercritical $CO_2$ flows via 105 from a heat source 150 to the double-wall turboexpander 110. The expansion of the supercritical $CO_2$ in the double-wall turboexpander 110 generates a shaft output that may be used to supply energy to other process equipment (e.g., compressor 130) and/or to supply energy to electrical generation equipment (e.g., generator 160).

The double-wall turboexpander 110 includes at least an inner chamber 112 through which the supercritical $CO_2$ flows and an outer chamber 114 receiving one or more thermal attenuators disposed therein. As depicted in FIG. 1, in embodiments, the thermal attenuator may include one or more coolants that flow through the outer chamber 114. In other embodiments (not depicted in FIG. 1), the thermal attenuator may include one or more insulative materials disposed in the outer chamber 114. An inner chamber wall separates the inner chamber 112 from the outer chamber 114. The thermal attenuator in the outer chamber 114 removes heat from the turboexpander 110 and insulates the outer chamber wall of the turboexpander housing from the high temperatures present in the inner chamber 112. The supercritical $CO_2$ flows through the inner chamber 112 housing the turbine. As depicted in FIG. 1, a thermal attenuator in the form of a coolant, which may include compressed $CO_2$, flows via 175 through the outer chamber of the turboexpander 110, cooling the turboexpander.

Supercritical $CO_2$ at a first, elevated, temperature (e.g., 1200° C.) and at a first, elevated, pressure (e.g., 150 Bar) flows 105 from a heat source 150 to the inner chamber 112 of the double-wall turboexpander 110. The expansion of the supercritical $CO_2$ the inner chamber 112 of the double-wall turboexpander 110 reduces the temperature of the supercritical $CO_2$ to a second, lower, temperature (e.g., 600° C.) and reduces the pressure of the supercritical $CO_2$ to a second, lower, pressure (e.g., 1 Bar) and pressure of the supercritical $CO_2$. The temperature and pressure loss in the inner chamber 112 is converted to a shaft output using an expansion turbine disposed in the inner chamber 112.

The expanded supercritical $CO_2$ flows 115 from the double-wall turboexpander 110 to a thermal energy exchanger 120 where the residual heat in the expanded supercritical $CO_2$ is used to heat the supercritical $CO_2$ feed 145 to the heater 150. The cooled, expanded supercritical $CO_2$ flows 125 from the thermal energy exchanger 120 to a compressor 130. In embodiments, a portion of the shaft work provided by the double-wall turboexpander 110 may be used to drive the compressor 130.

In embodiments, a first portion of the cooled, compressed, supercritical $CO_2$, at a third temperature and a third pressure, flows via 135 from the compressor 130 to the thermal energy exchanger 120. A second portion of the cooled, compressed, supercritical $CO_2$ flows via 175 through the outer chamber 114 of the double-wall turboexpander 110. The warmed, compressed, supercritical $CO_2$ flowing via 145 from the thermal energy exchanger 120 and the warmed, compressed, supercritical $CO_2$ flowing via 185 from the outer chamber 114 of the double-wall turboexpander 110 are combined to provide a supercritical $CO_2$ feed that flows via 145 to the heat source 150.

The turboexpander 110 may include any number and/or combination of double-walled components capable of receiving supercritical $CO_2$ at a first temperature and a first pressure and expanding the supercritical $CO_2$ to a lower second temperature and a lower second pressure to generate a shaft output capable of driving additional devices. The turboexpander 110 includes an inner chamber 112 housing the turbine. An inner chamber wall separates the inner chamber 112 from an outer chamber 114 that at least partially encompasses or encloses the inner chamber 112. In embodiments, the outer chamber 114 may receive a flow of coolant via 175 at a third temperature that is less than the first temperature of the supercritical $CO_2$ introduced to the inner chamber 112 via 105. In embodiments, the coolant received via 175 at the outer chamber 114 may be at a third pressure that is lower than the first pressure of the supercritical $CO_2$ introduced to the inner chamber 112 via 105.

The material used to form the inner housing wall that separates the inner chamber 112 from the outer chamber 114 may have the same or a different composition and/or thickness than the material forming the external housing (i.e., a portion of the outer housing 114) of the turboexpander 110. In embodiments, the material used to form the inner housing wall may include a high temperature alloy material capable of withstanding the operating temperatures (i.e., the first temperature) of the supercritical $CO_2$ received via 105 from the heat source 150. By maintaining the pressure of the coolant flowing through the outer chamber 114 within a range of from about 10 Bar to about 50 Bar below the pressure of the supercritical $CO_2$ in the inner chamber 112, the differential pressure across the inner chamber wall is less than the full 150 Bar pressure of the supercritical $CO_2$ in the inner chamber. Maintaining the differential pressure across the inner chamber wall at a level below the pressure of the supercritical $CO_2$ flowing through the inner chamber 112 beneficially and advantageously permits the use of less high-temperature material to fabricate a thinner inner chamber wall than if the full pressure of the supercritical $CO_2$ flowing through the inner chamber 112 was taken across the inner chamber wall. For example, the inner chamber wall can be fabricated thinner if taking a differential pressure of 25 Bar (150 Bar inner chamber pressure less 125 Bar outer chamber pressure) rather than the full pressure of the supercritical $CO_2$ (150 Bar). Since the inner chamber wall is typically fabricated using a high-temperature alloy, a significant savings in both material costs and fabrication costs may be realized using a thinner inner chamber wall.

The external housing or casing of the turboexpander 110 forms at least a portion of the outer chamber 114. A thermal attenuator, such as a flowing coolant or insulation, disposed in the outer chamber 114 beneficially limits the operating temperature of the external housing of the turboexpander 110 to a third temperature that is less than the first temperature. For example, in the absence of the outer chamber 114, flowing 1200° C. supercritical $CO_2$ through the turboexpander would expose the external housing or casing of the turboexpander 110 to a temperature of 1200° C. and a pressure of 150 Bar. By forming the outer chamber 114 in the turboexpander housing and disposing a thermal attenuator, such as a coolant flow, through the outer chamber 114, the external housing or casing of the turboexpander 110 may be maintained at a third temperature of 700° C. (i.e., less than the first temperature) and third pressure of 125 Bar (i.e., less than the first pressure). The reduced temperature and pressure to which the external housing, casing, or wall of the turboexpander 110 is exposed beneficially and advantageously permits the use of a lower temperature alloy for fabrication of the turboexpander housing.

The thermal energy exchanger 120 may include any number and/or combination of systems and/or devices capable of decreasing the enthalpy of the supercritical $CO_2$ received from the turboexpander 110 and increasing the enthalpy of the supercritical $CO_2$ received from the compressor 130. In embodiments, the thermal energy exchanger 120 may transfer at least a portion of the thermal energy contained in the relatively warmer supercritical $CO_2$ received via 115 to the relatively cooler supercritical $CO_2$ received via 135. In embodiments, the thermal energy exchanger 120 may include, but is not limited to, at least one: plate and frame heat exchanger, shell and tube heat exchanger, double pipe heat exchanger, spiral heat exchanger, or any combination thereof. In embodiments, the thermal energy exchanger 120 may include one or more heat exchangers configured for concurrent flow or countercurrent flow regimes. Although not depicted in FIG. 1, in embodiments, the thermal energy exchanger 120 may include one or more active cooling devices and/or systems, such as one or more chillers, cooling towers, finned tube coolers, or combinations thereof. Such active cooling devices may be used to further reduce the temperature of the supercritical $CO_2$ that flows via 125 from the thermal energy exchanger 120 to the compressor 130.

The compressor 130 may include any number and/or combination of systems and/or devices capable of increasing the enthalpy of the supercritical $CO_2$ received from the thermal energy exchanger 120 via 125. In embodiments, the compressor 130 may increase the enthalpy of the supercritical $CO_2$ received from the thermal energy exchanger 120 by increasing either or both the pressure and/or the temperature of the received supercritical $CO_2$.

The heat source 150 may include one or more thermal energy sources that are used to increase the enthalpy of the supercritical $CO_2$ received from the thermal energy exchanger 120 via 145. Example heat sources 150 may include, but are not limited to: solar energy production facilities, nuclear energy production facilities, geothermal energy production facilities, or combinations thereof. In some implementations, the heat source 150 may include one or more waste heat sources, such as: a cement production process, a chemical production process, or an incineration process such as a municipal trash incineration process—all of which generate a significant volume of waste heat that can be advantageously monetized in the form electrical energy using the systems and methods described herein.

The electrical generator 160 may be operably coupled to the turboexpander 110 such that shaft work produced by the turbo expander drives the electrical generator 160. The electrical generator 160 may include any number and/or combination of systems and/or devices capable of receiving a shaft input and generating an electrical energy output. Although depicted as driving an electrical generator 160 in FIG. 1, in embodiments, the turboexpander 110 may be used to drive any number and/or combination of rotating and/or reciprocating systems or devices including, but not limited to, chemical, energy production, or industrial process equipment such as pumps, compressors, blowers, and similar.

Figure 2A:
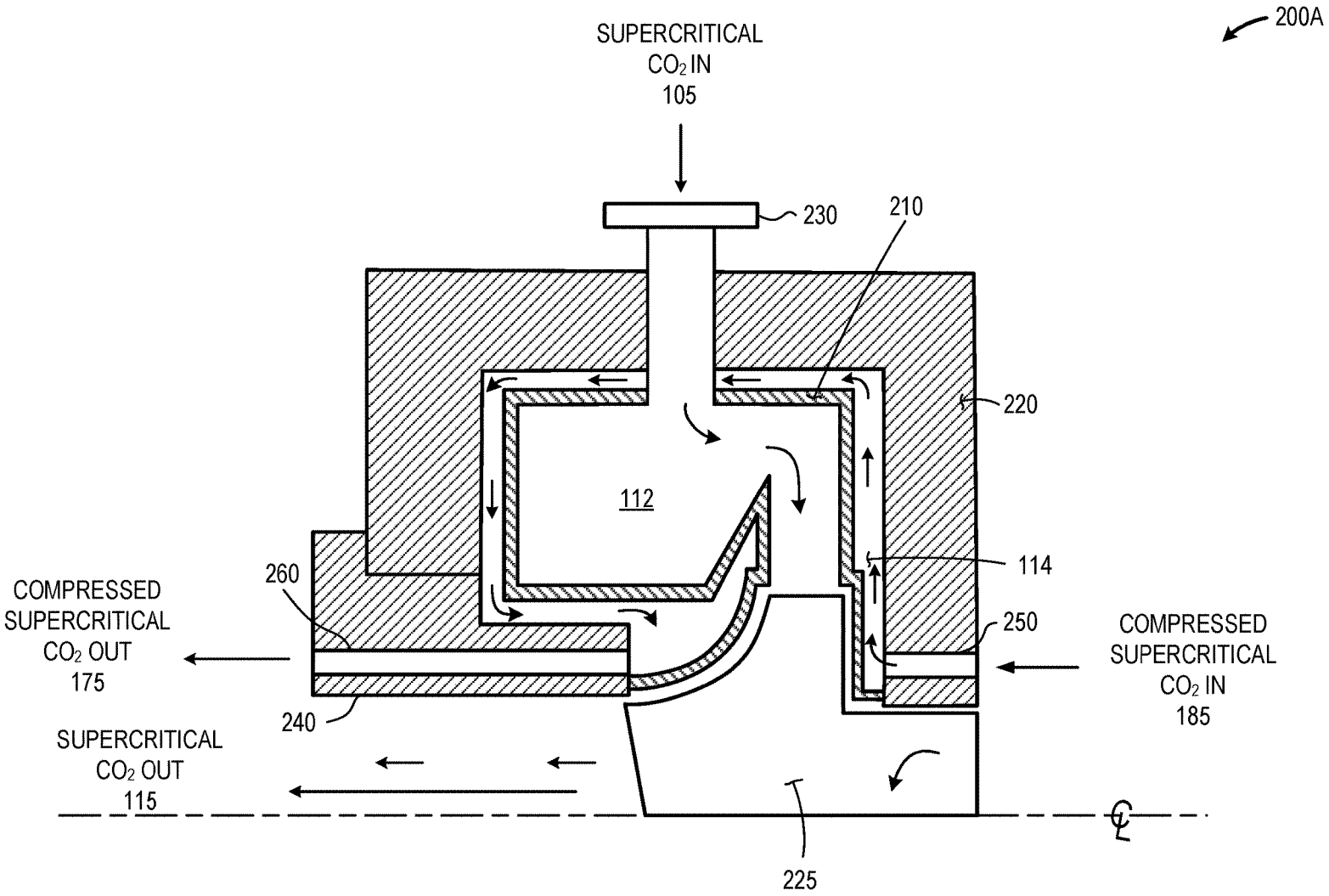
FIG. 2A is a partial cross-sectional elevation of an illustrative turboexpander that more clearly depicts the inner chamber, a flow-through outer chamber, the inner chamber wall that separates the inner chamber from the flow-through outer chamber, and the outer chamber wall that forms at least a portion of the external housing of the turboexpander, in accordance with at least one embodiment described herein.

FIG. 2A is a partial cross-sectional elevation of an illustrative turboexpander 110 that more clearly depicts the inner chamber 112, a flow-through outer chamber 114, the inner chamber wall 210 that separates the inner chamber 112 from the flow-through outer chamber 114, and the outer chamber wall 220 that forms at least a portion of the external housing of the turboexpander 110, in accordance with at least one embodiment described herein. FIG. 2A depicts an illustrative flow path for the supercritical $CO_2$ through the inner chamber 112 of the turboexpander 110, including a supercritical $CO_2$ inlet 230 and a supercritical $CO_2$ outlet 240 that are fluidly coupled to the inner chamber 112. FIG. 2A also depicts an illustrative flow path for a coolant, such as low temperature supercritical $CO_2$, through the outer chamber 114 of the turboexpander 110, including a coolant inlet 250 and a coolant outlet 260 that are fluidly coupled to the outer chamber 114.

As depicted in FIG. 2A, maintaining a differential pressure across the inner chamber wall 210 of less than the operating pressure of the inner chamber 112 permits the fabrication of the wall using a relatively thin (compared to the outer chamber wall) high-temperature alloy material, reducing the amount of material required, the fabrication required, and the resultant cost of the inner chamber wall 210. In embodiments, the inner chamber wall 210 may be disposed within the turboexpander 110 such that, in operation, a sufficient clearance is maintained between the turbine 225 and the inner chamber wall 210. In embodiments, the differential pressure across the inner chamber wall 210 may be maintained at a differential (i.e., inner chamber pressure minus outer chamber pressure) of: about 100 Bar; about 80 Bar; about 60 Bar; about 40 Bar; about 30 Bar; about 20 Bar or about 10 Bar. In embodiments, the inner chamber wall 210 may operate at a temperature of less than; about 600° C.; about 650° C.; about 700° C.; about 750° C.; about 800° C.; about 850° C.; or about 900° C. Example materials suitable for the high temperature conditions found in the inner chamber 112 include, but are not limited to: nickel and nickel containing alloys (INCONEL® 600, INCONEL® 601, HASTELLOY® X); titanium and titanium containing alloys; and/or Cobalt alloys)(WASPALOY®. In embodiments, the inner chamber wall 210 may have a thickness of less than: about 2 inches (in); about 2.5 in; about 3 in; about 3.5 in; or about 4 in. In embodiments, the inner chamber wall 210 may be physically coupled to the outer chamber wall 220 at a limited number of locations to accommodate the differential thermal expansion experienced during operation by the inner chamber wall 210 and the outer chamber wall 220. For example, the inner chamber wall 210 may be physically coupled to the outer chamber wall in locations proximate the supercritical $CO_2$ inlet 230, the supercritical $CO_2$ outlet 240, the coolant inlet 250, and/or the coolant outlet 260.

The differential pressure across the outer chamber wall 220 is determined based upon the coolant pressure in the outer chamber 114. In embodiments, the differential pressure across the outer wall may exceed the differential pressure across the inner chamber wall 210. For example, the pressure drop across the outer chamber wall 220 may be in excess of: about 25 Bar; about 50 Bar; about 75 Bar; about 100 Bar; about 125 Bar; about 150 Bar; or about 175 Bar. The flow of coolant in the outer chamber 114 reduces the operating temperature of the outer chamber wall 220 relative to the inner chamber wall 210. Thus, while the outer chamber wall 220 may see a greater differential pressure than the inner chamber wall 210, it does so at an operating temperature that is cooler than the operating temperature of the inner chamber wall 210. Such beneficially permits the fabrication of the outer chamber wall 220 without requiring the use of a high-temperature alloy such as used to fabricate the inner chamber wall 210. In embodiments, the outer chamber wall 220 may operate at a temperature of less than; about 200° C.; about 300° C.; about 400° C.; or about 500° C. Example materials suitable for the expected operating temperature of the outer chamber wall 220 include, but are not limited to: austenitic stainless steels (304, 304L, 308, 308L, 309L, 310L, 316L, Alloy 20/Carpenter 20); nickel and nickel containing alloys (INCOLOY®, INCONEL®, HASTELLOY® X), titanium and titanium containing alloys; and/or Cobalt alloys (WASPALOY®). In embodiments, the inner chamber wall 210 may have a thickness of less than: about 2 inches (in); about 2.5 in; about 3 in; about 3.5 in; about 4 in; about 4.5 in; about 5 in; about 5.5 in; about 6 in; about 6.5 in; or about 7 in.

Figure 2B:
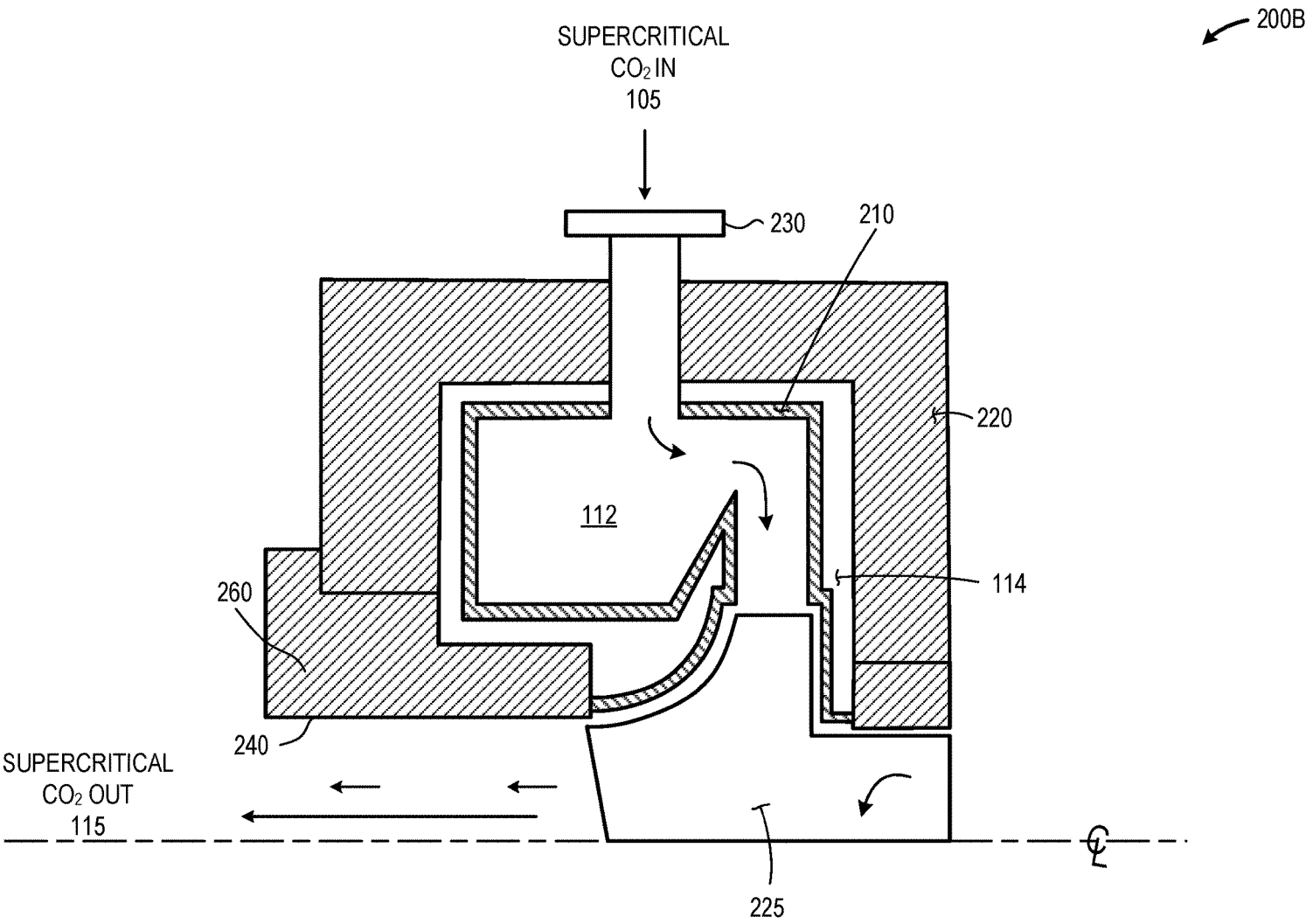
FIG. 2B is a partial cross-sectional elevation of an illustrative turboexpander that more clearly depicts the inner chamber, a closed outer chamber, the inner chamber wall that separates the inner chamber from the closed outer chamber, and the outer chamber wall that forms at least a portion of the external housing of the turboexpander, in accordance with at least one embodiment described herein.

FIG. 2B is a partial cross-sectional elevation of an illustrative turboexpander 110 that more clearly depicts the inner chamber 112, a closed outer chamber 114, the inner chamber wall 210 that separates the inner chamber 112 from the closed outer chamber 114, and the outer chamber wall 220 that forms at least a portion of the external housing of the turboexpander 110, in accordance with at least one embodiment described herein. FIG. 2B depicts a closed outer chamber 114 in which a thermal attenuator, such as an insulative material, may be disposed to maintain the outer chamber wall at or below the third temperature. In embodiments, the closed outer chamber 114 may be maintained at a third pressure maintained at or above ambient pressure and at or below the first pressure.

Figure 3A:
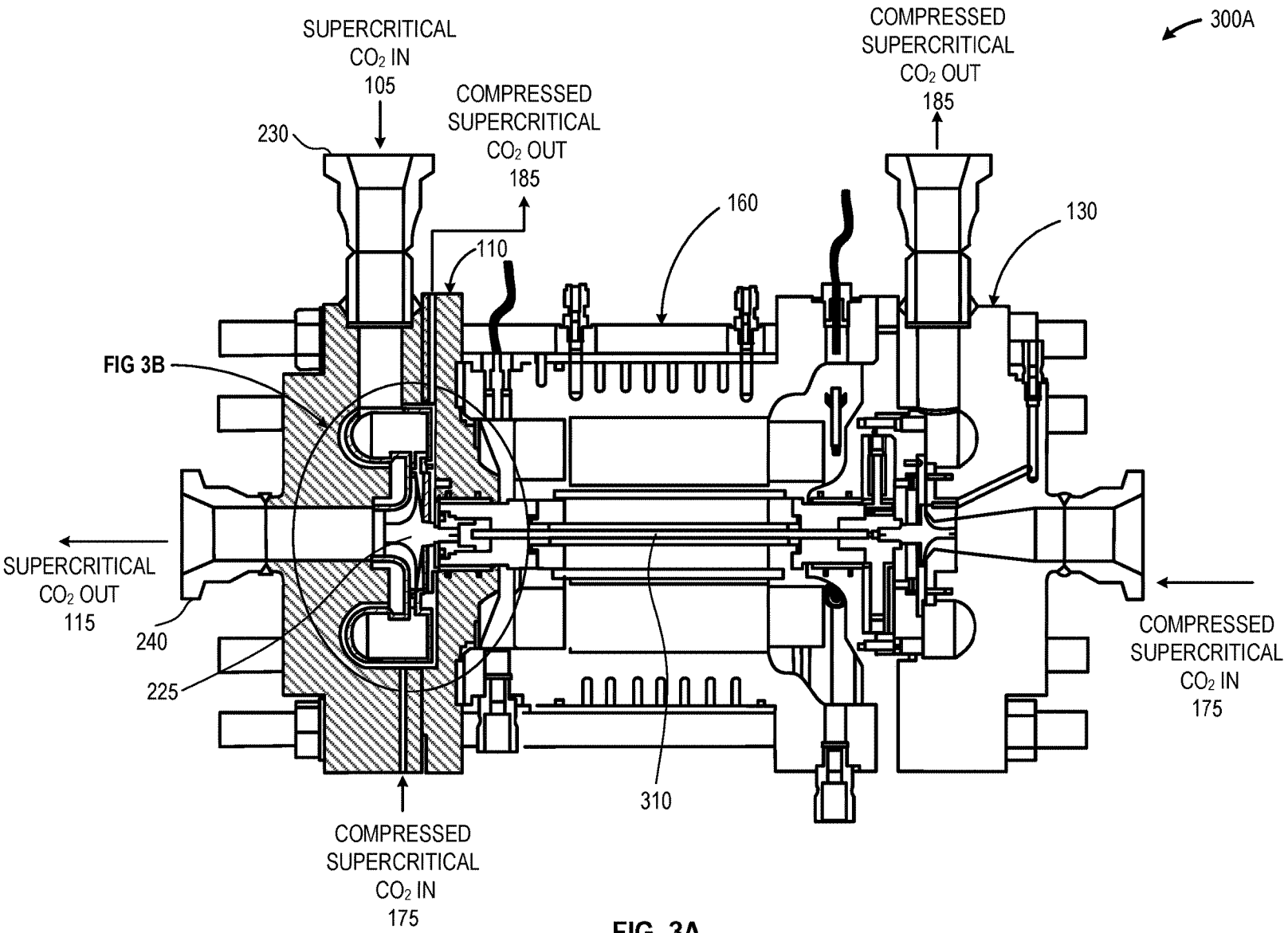
FIG. 3A is a cross-sectional elevation of an illustrative double-wall turboexpander that includes a close coupled electrical generator and compressor, in accordance with at least one embodiment described herein.
Figure 3B:
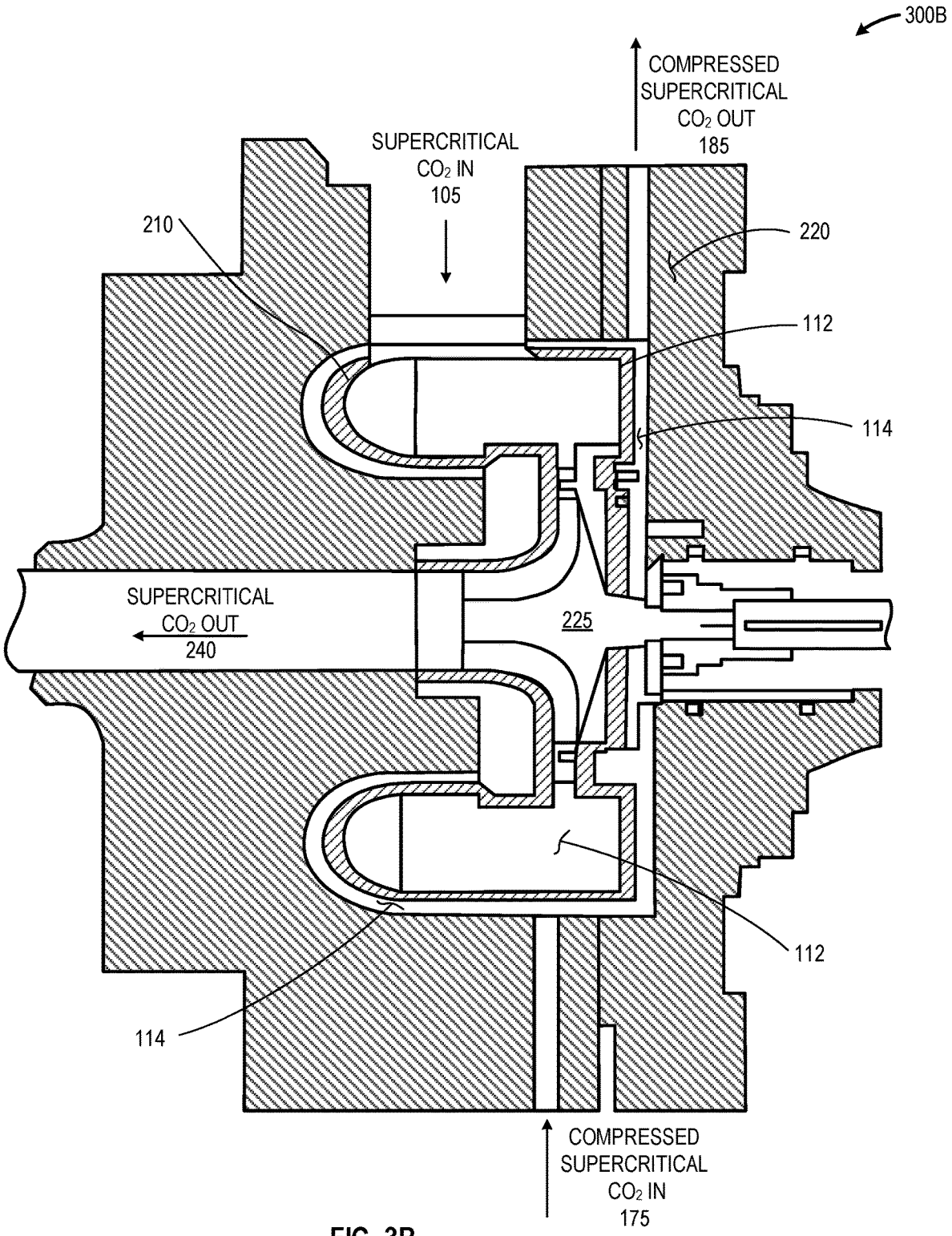
FIG. 3B is a more detailed cross-sectional elevation of the designated portion of FIG. 3A to clearly show the relationship between the inner chamber wall, the outer chamber wall, the inner chamber the outer chamber, and the turbine in accordance with at least one embodiment described herein.

FIG. 3A is a cross-sectional elevation of an illustrative double-wall turboexpander 110 that includes a close coupled electrical generator 160 and compressor 130, in accordance with at least one embodiment described herein. FIG. 3B is a more detailed cross-sectional elevation of the designated portion of FIG. 3A to clearly show the relationship between the inner chamber wall 210, the outer chamber wall 220, the inner chamber 112 the outer chamber 114, and the turbine 225 in accordance with at least one embodiment described herein. As depicted in FIG. 3A, in embodiments, the double-wall turboexpander 110 may be close coupled to an electrical generator 160 and/or additional process equipment, such as compressor 130. In such implementations, a shaft 310 may operably couple some or all of the components driven by the turbine 225. In some implementations, one or more speed reduction systems may be operably coupled between the turbine 225 and the electrical generator 160 and/or compressor 130.

Figure 4:
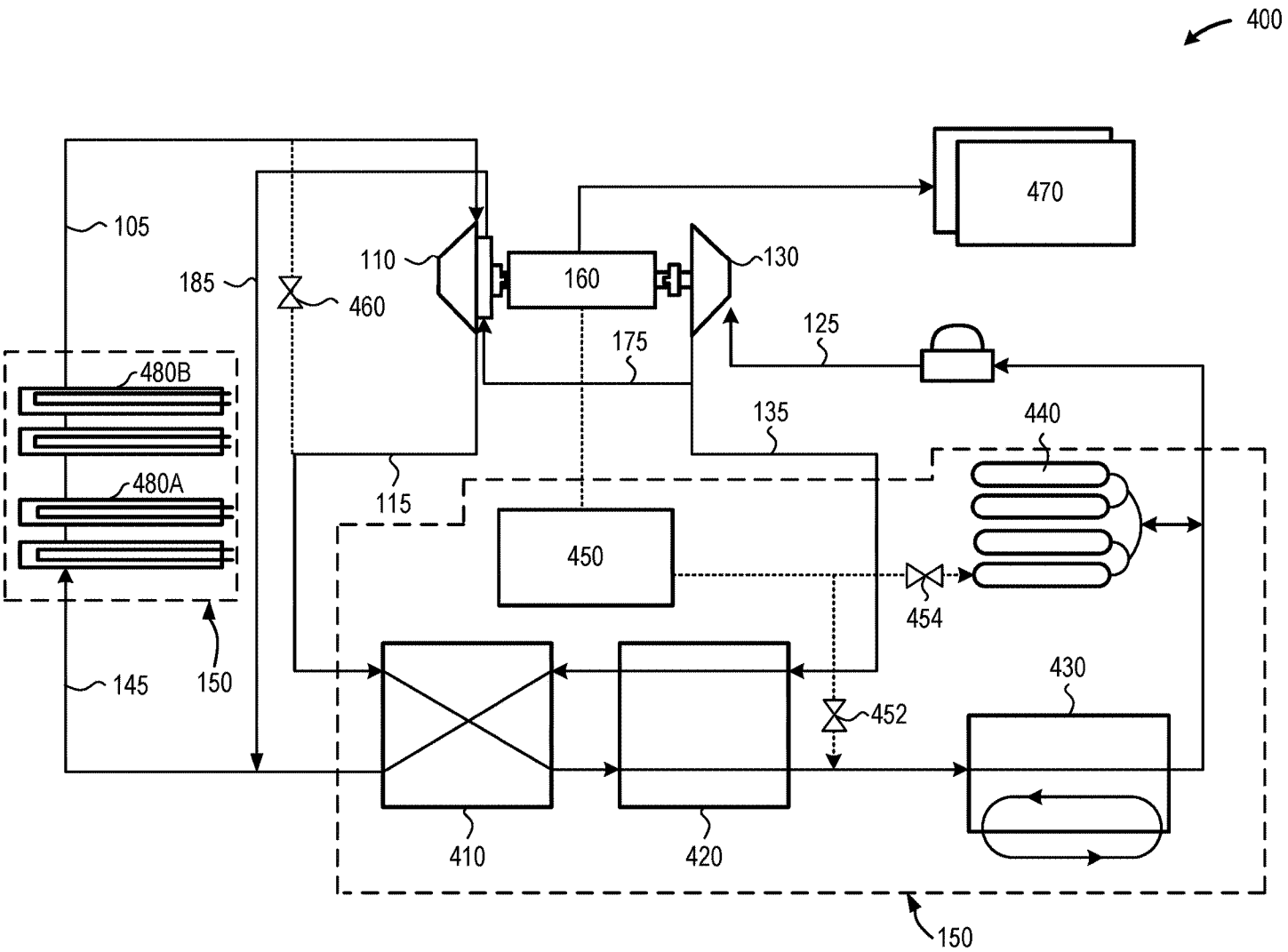
FIG. 4 is a process flow diagram depicting an illustrative system for generating electrical power using a double-wall turboexpander to implement Brayton Cycle supercritical $CO_2$ power generation process, in accordance with at least one embodiment described herein.

FIG. 4 is a process flow diagram depicting an illustrative system 400 for generating electrical power using a double-wall turboexpander 110 to implement Brayton Cycle supercritical $CO_2$ power generation process, in accordance with at least one embodiment described herein. As depicted in FIG. 4, the thermal energy exchanger 120 may include, but is not limited to: a high-temperature recuperator 410, a series connected low-temperature recuperator 420, a chiller 430, $CO_2$ expansion tanks 440, and one or more Hydropac pumps 450. The one or more Hydropac pumps 450 and the $CO_2$ expansion tanks 440 provide additional $CO_2$ either directly to the process via 452 or to storage in the $CO_2$ expansion tanks 440 via 454. In some implementations, the chiller 430 may include one or more printed circuit heat exchangers (PCHE).

As depicted in FIG. 4, supercritical $CO_2$ is heated using a heat source 150. In embodiments, the heat source 150 may include a plurality of individual heat generators 480A-480*n* (collectively, "heat generators 480"). Such heat generators 480 may include any number and/or combination of power generation heat sources (geothermal, nuclear, solar, etc.) and/or any number and/or combination of exothermic industrial/commercial/chemical processes. The heated supercritical $CO_2$ flows via 105 to the double-wall turboexpander 110. In embodiments, a portion of the heated supercritical $CO_2$ may bypass the double-wall turboexpander 110 via 460. In some implementations, the volume of supercritical $CO_2$ bypassing the double-wall turboexpander 110 via 460 may be based, at least in part, on controlling the mass or volumetric flowrate of supercritical $CO_2$ through the double-wall turboexpander 110.

The expanded supercritical $CO_2$ exits the double-wall turboexpander 110 via 115 and is introduced to the thermal energy exchanger 120. The thermal energy exchanger 120 includes one or more high-temperature recuperators 410 arranged in a cascade configuration with one or more low-temperature recuperators 420. The expanded supercritical $CO_2$ may is passed sequentially through the one or more high-temperature recuperators 410 and then through the one or more low-temperature recuperators 420. The compressed supercritical $CO_2$ from the compressor 130 is passed counter-currently through the one or more low-temperature recuperators 420 and then through the one or more high-temperature recuperators 410. Heat recovered from the expanded supercritical $CO_2$ from the double-wall turboexpander 110 is beneficially economized to pre-heat the supercritical $CO_2$ that exits the compressor 130.

In some implementations, the expanded supercritical $CO_2$ may be further cooled using one or more chillers 430 or similar pieces of active (i.e., energy consuming to produce cooling) cooling equipment. In some instances, the one or more chillers 430 may include one or more printed circuit heat exchangers (PCHEs). The cooled expanded supercritical $CO_2$ then flows via 125 to the compressor 130. Cooling the supercritical $CO_2$ prior to introducing the supercritical $CO_2$ to the compressor may beneficially reduce the compressor work input (i.e., energy) required to compress the supercritical $CO_2$ prior to returning the supercritical $CO_2$ to the heat source 150.

The chiller 130 increases the enthalpy of the supercritical $CO_2$ and discharges a first portion of the compressed supercritical $CO_2$ to the thermal energy exchanger 120 via 135 and a second portion of the compressed supercritical $CO_2$, as a coolant, to the outer chamber 114 of the double-wall turboexpander 110 via 175. The portion of the compressed supercritical $CO_2$ directed to the thermal energy exchanger 120 via 135 passes through the thermal energy exchanger 120 counter-current to the expanded supercritical $CO_2$ received from the inner chamber 112 of the double-wall turboexpander 110. The portion of the compressed supercritical $CO_2$ directed to the outer chamber 114 of the double-wall turboexpander 110 passes through the outer chamber 114 of the double-wall turboexpander 110 and is returned via 185 to the compressed supercritical $CO_2$ that passed through the thermal energy exchanger 120 prior to being directed to the heat source 150 via 145.

In embodiments, the shaft work produced by the double-wall turboexpander 110 may be used as an input to one or more electrical generators 160 and/or one or more compressors 130. In embodiments, the electrical power produced by the one or more electrical generators 160 may be stored using one or more energy storage devices 470, such as one or more load banks or similar. In some embodiments, at least a portion of the electrical energy produced by the one or more electrical generators 160 may power one or more compressors 450, such as one or more Hydropac pumps that may compress additional carbon dioxide. In some implementations, all or a portion of the compressed carbon dioxide may be introduced to the thermal energy exchanger 120 via 452. In some implementations all or a portion of the compressed carbon dioxide may be stored or otherwise retained in one or more process expansion tanks 440.

Figure 5:
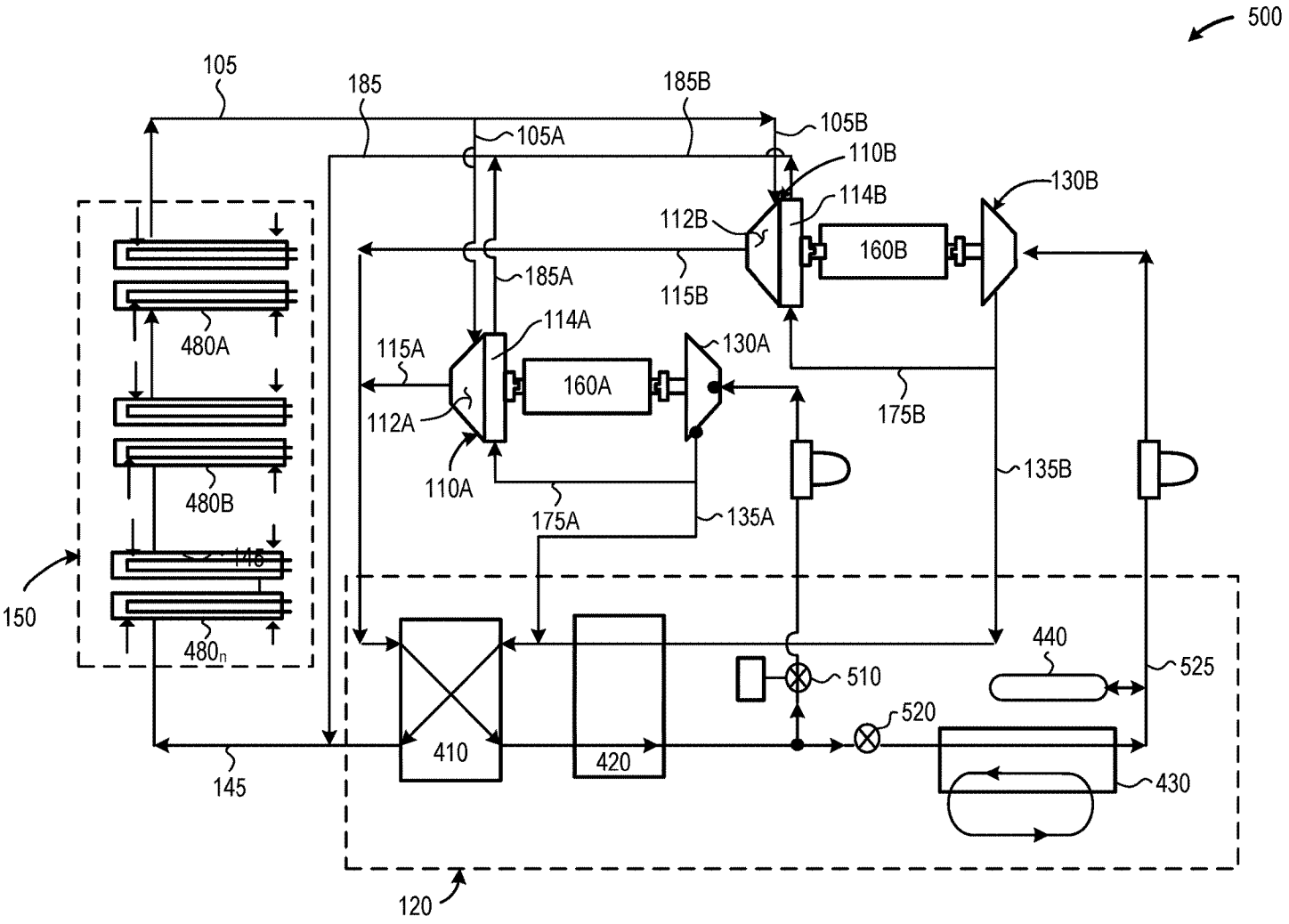
FIG. 5 is a process flow diagram depicting an illustrative system for generating electrical power using a plurality of double-wall turboexpanders to implement a Brayton Cycle supercritical $CO_2$ power generation process, in accordance with at least one embodiment described herein.

FIG. 5 is a process flow diagram depicting an illustrative system 500 for generating electrical power using a plurality of double-wall turboexpanders 110A, 110B to implement Brayton Cycle supercritical $CO_2$ power generation process, in accordance with at least one embodiment described herein. Although only two double-wall turboexpanders are depicted in FIG. 5, any number of double-wall turboexpanders 110A-110*n* may be similarly arranged, configured, and/or operated and such arrangements should be considered as included in this disclosure. As depicted in FIG. 5, the thermal energy exchanger 120 may include, but is not limited to: one or more series connected high-temperature recuperators 410, low-temperature recuperators 420, and chillers 430. In some implementations, the chiller 430 may include one or more printed circuit heat exchangers (PCHE).

The system 500 may include one or more expansion tanks 440 to accommodate additional volumes of $CO_2$ generated by process fluctuations.

The supercritical $CO_2$ is heated using a heat source 150, increasing the enthalpy of the supercritical $CO_2$. In embodiments, the heat source 150 may include a plurality of individual heat generators 480A-480*n* (collectively, "heat generators 480"). Such heat generators 480 may include any number and/or combination of power generation heat sources (geothermal, nuclear, solar, etc.) and/or any number and/or combination of exothermic industrial, commercial, and/or chemical processes. The supercritical $CO_2$ flows from the heat source 150 via 105 and 105A to double-wall turboexpander 110A and via 105 and 105B to double-wall turboexpander 110B. The flow of supercritical $CO_2$ may be evenly or unevenly allocated or apportioned among the plurality of double-wall turboexpanders 110.

Within double-wall turboexpander 110A, the supercritical $CO_2$ expands, reducing the temperature and pressure (i.e., the enthalpy) of the supercritical $CO_2$ present in the double-wall turboexpander. The turbine within the double-wall turboexpander 110A converts the reduction in enthalpy to shaft work used to drive the electrical generator 160A and/or the compressor 130A. The expanded supercritical $CO_2$ exits the double-wall turboexpander 110A via 115A. Similarly, within double-wall turboexpander 110B, the supercritical $CO_2$ expands, reducing the enthalpy of the supercritical $CO_2$ present in the double-wall turboexpander. The turbine within the double-wall turboexpander 110B converts the reduction in enthalpy to shaft work used to drive the electrical generator 160B and/or the compressor 130B. The expanded supercritical $CO_2$ exits the double-wall turboexpander 110B via 115B.

The expanded supercritical $CO_2$ from both double-wall turboexpander 110A and double-wall turboexpander 110B is combined and flows via 115 to the thermal energy exchanger 120. The thermal energy exchanger 120 includes one or more high-temperature recuperators 410 arranged in a cascade configuration with one or more low-temperature recuperators 420. The expanded supercritical $CO_2$ may is passed sequentially through the one or more high-temperature recuperators 410 and then through the one or more low-temperature recuperators 420. In embodiments, at least a portion of the compressed supercritical $CO_2$ received from the compressors 130A and 130B passes counter-currently through the one or more low-temperature recuperators 420 and then through the one or more high-temperature recuperators 410. Heat recovered from the expanded supercritical $CO_2$ from the double-wall turboexpander 110 is beneficially economized to pre-heat the supercritical $CO_2$ received from the compressors 130A and 130B.

In embodiments, a first portion of the expanded supercritical $CO_2$ may flow via 510 to compressor 130A. The remaining portion of the expanded supercritical $CO_2$ may flow, via 520, to one or more chillers 430 or similar pieces of active (i.e., energy consuming to produce cooling) cooling equipment. In some instances, the one or more chillers 430 may include one or more printed circuit heat exchangers (PCHEs). The cooled expanded supercritical $CO_2$ then flows via 525 to compressor 130B. Cooling the supercritical $CO_2$ prior to introducing the supercritical $CO_2$ to compressor 130B may beneficially reduce the compressor work input (i.e., energy) required to compress the supercritical $CO_2$ prior to returning the supercritical $CO_2$ to the heat source 150.

Compressor 130A increases the enthalpy of the supercritical $CO_2$ and discharges a first portion of the compressed supercritical $CO_2$ to the high-temperature recuperator 410 via 135A and a second portion of the compressed supercritical $CO_2$, as a coolant, to the outer chamber 114A of the double-wall turboexpander 110A via 175A. Compressor 130B increases the enthalpy of the supercritical $CO_2$ and discharges a first portion of the compressed supercritical $CO_2$ to the low-temperature recuperator 420 via 135B and a second portion of the compressed supercritical $CO_2$, as a coolant, to the outer chamber 114B of the double-wall turboexpander 110B via 175B.

The portion of the compressed supercritical $CO_2$ directed to the high-temperature recuperator 410 via 135A and the portion of the compressed supercritical $CO_2$ directed to the low-pressure recuperator 420 via 135B pass through the thermal energy exchanger 120 counter-current to the expanded supercritical $CO_2$ received from the inner chamber 112A of double-wall turboexpander 110A and the expanded supercritical $CO_2$ received from the inner chamber 112B of double-wall turboexpander 110B. The portion of the compressed supercritical $CO_2$ directed to the outer chamber 114A of the double-wall turboexpander 110A and the portion of the compressed supercritical $CO_2$ directed to the outer chamber 114B of the double-wall turboexpander 110B may be combined. The combined supercritical $CO_2$ may be returned, via 185A, to the compressed supercritical $CO_2$ that passed through the thermal energy exchanger 120 prior to being directed to the heat source 150 via 145.

Figure 6:
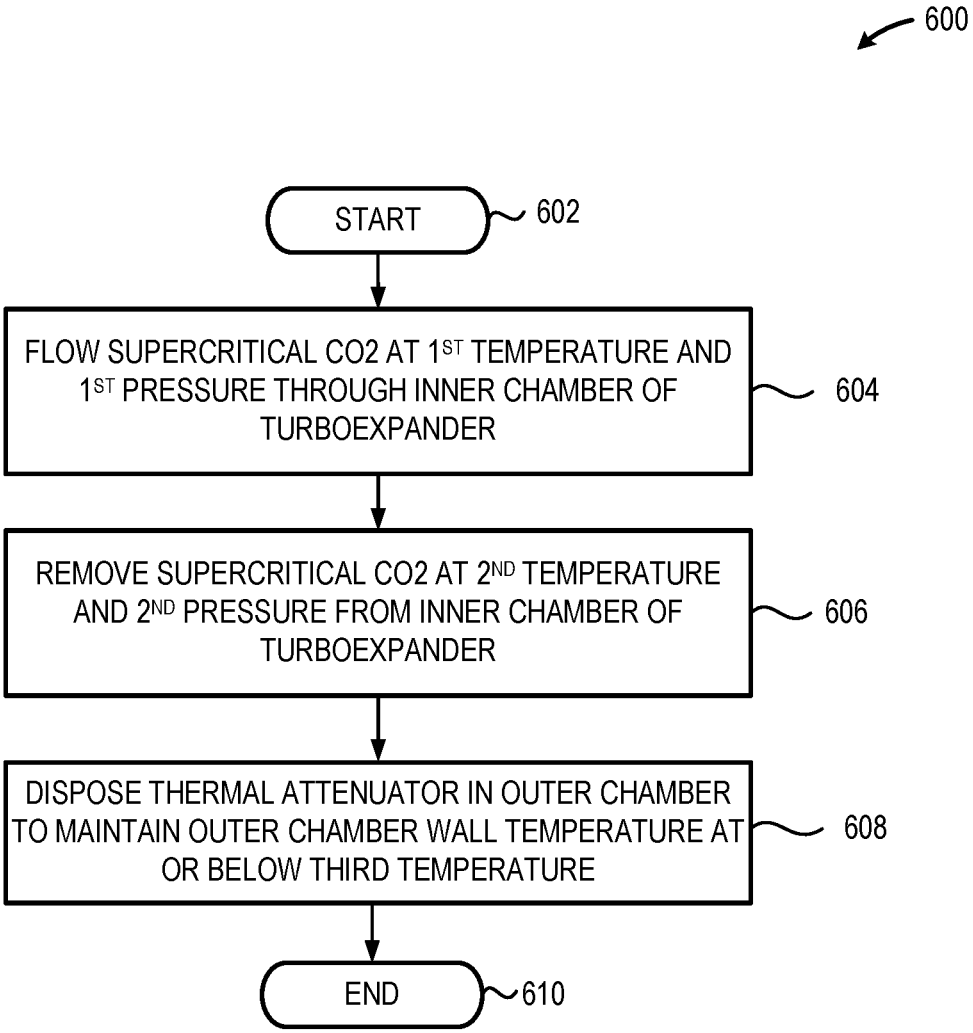
FIG. 6 is a high-level flow diagram of an illustrative method of generating shaft work using a double-wall turboexpander, in accordance with at least one embodiment described herein.

FIG. 6 is a high-level flow diagram of an illustrative method 600 of generating shaft work using a double-wall turboexpander 110, in accordance with at least one embodiment described herein. The double-wall turboexpander 110 may include an inner chamber 112 and an outer chamber 114 separated by an inner chamber wall 210 fabricated using a high-temperature alloy material. Maintaining the operating pressure within the outer chamber 114 at an elevated (i.e., above atmospheric) pressure reduces the differential pressure across the inner chamber wall, reducing the mechanical or physical loading on the inner chamber wall 210. Reducing the mechanical forces on the inner chamber wall 210 beneficially reduces the thickness of the inner chamber wall 210. Flowing a coolant through the outer chamber 114 beneficially reduces the operating temperature of the outer chamber wall (i.e., the exterior of the double-wall turboexpander 110) permitting the use of a relatively low-temperature alloy to fabricate the outer chamber wall double-wall turboexpander 110. The method 600 commences at 602.

At 604, supercritical $CO_2$ at a first temperature and a first pressure is introduced into the inner chamber 112 of the double-wall turboexpander 110. In embodiments, the supercritical $CO_2$ introduced to the inner chamber 112 of the double-wall turboexpander 110 may be at a temperature (i.e., the first temperature) of less than: about 500° C.; about 550° C.; about 600° C.; about 650° C.; about 700° C.; about 750° C.; about 800° C.; about 850° C.; about 900° C.; about 950° C.; or about 1000° C. In embodiments, the supercritical $CO_2$ introduced to the inner chamber 112 of the double-wall turboexpander 110 may be at a pressure (i.e., the first pressure) of greater than: about 150 Bar; about 175 Bar; about 200 Bar; about 225 Bar; about 250 Bar; about 275 Bar; or about 300 Bar. Within the inner chamber 112, the supercritical $CO_2$ expands across the turbine 225, generating a shaft work output. In embodiments, the shaft work output may be used to power one or more electrical generators 160 and/or process equipment, such as one or more compressors 130.

At 606, the expanded supercritical $CO_2$ at a second temperature and a second pressure is removed from the inner chamber 112 of the double-wall turboexpander 110. The second temperature may be less than the first temperature and the second pressure may be less than the first pressure. In embodiments, the expanded supercritical $CO_2$ removed from the inner chamber 112 of the double-wall turboexpander 110 may be at a temperature (i.e., the second temperature) of greater than: about 300° C.; about 350° C.; about 400° C.; about 450° C.; about 500° C.; about 550° C.; about 600° C.; about 650° C.; or about 700° C. In embodiments, the expanded supercritical $CO_2$ removed from the inner chamber 112 of the double-wall turboexpander 110 may be at a pressure (i.e., the second pressure) of less than: about 50 Bar; about 75 Bar; about 100 Bar; about 125 Bar; about 150 Bar; about 175 Bar; about 200 Bar; about 225 Bar; or about 250 Bar. The expanded supercritical $CO_2$ may be cooled using one or more thermal energy exchangers 120 and may be compressed using one or more compressors 130.

At 608, a thermal attenuator is disposed in the outer chamber 114. The thermal attenuator maintains the outer chamber wall at a third temperature that is less than the temperature of the supercritical $CO_2$ entering the double-wall turboexpander. In embodiments, the thermal attenuator disposed in the outer chamber 114 may maintain the outer chamber wall temperature at or below: about 500° C.; about 400° C.; about 300° C.; about 250° C.; about 200° C.; about 150° C.; about 100° C.; or about 50° C. The method 600 concludes at 610.

Figure 7:
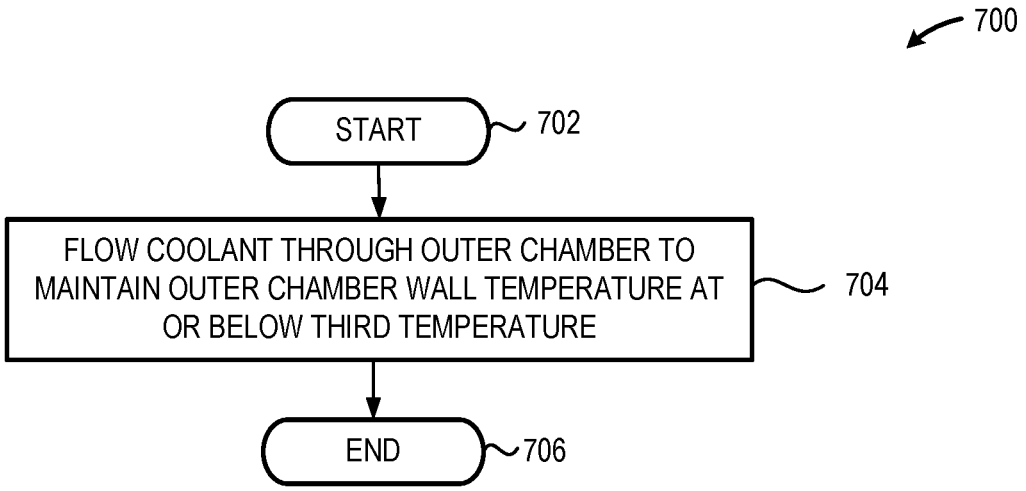
FIG. 7 is a high-level flow diagram of an illustrative method of generating shaft work using a double-wall turboexpander having a flow-through coolant in an outer chamber of the turboexpander, in accordance with at least one embodiment described herein.

FIG. 7 is a high-level flow diagram of an illustrative method 700 of generating shaft work using a double-wall turboexpander 110, in accordance with at least one embodiment described herein. The method 700 may be used in conjunction with the method 600 described in FIG. 6 above. The double-wall turboexpander 110 may include an inner chamber 112 and a flow-through outer chamber 114 separated by an inner chamber wall 210 fabricated using a high-temperature alloy material. Flowing a coolant through the outer chamber 114 maintains the outer chamber wall 220 of the double-wall turboexpander 110 at a third temperature that is at or below the first temperature of the supercritical $CO_2$ supplied to the inner chamber 112 of the double-wall turboexpander 110. The method 700 commences at 702.

At 704, a portion of the compressed supercritical $CO_2$ may be removed from the one or more compressors 130 and introduced, at the third temperature and a third pressure, to the outer chamber 114 of the double-wall turboexpander 110. In such implementations, the compressed supercritical $CO_2$ acts as a coolant in the double-wall turboexpander 110. In embodiments, the compressed supercritical $CO_2$ introduced to the outer chamber 114 of the double-wall turboexpander 110 may be at a temperature (i.e., the third temperature) of less than: about 100° C.; about 125° C.; about 150° C.; about 175° C.; about 200° C.; about 225° C.; about 250° C.; about 275° C.; or about 300° C. In embodiments, the compressed supercritical $CO_2$ introduced to the outer chamber 114 of the double-wall turboexpander 110 may be at a pressure (i.e., the third pressure) of less than: about 150 Bar; about 175 Bar; about 200 Bar; about 225 Bar; about 250 Bar; about 275 Bar; or about 300 Bar. The method 700 concludes at 704.

Figure 8:
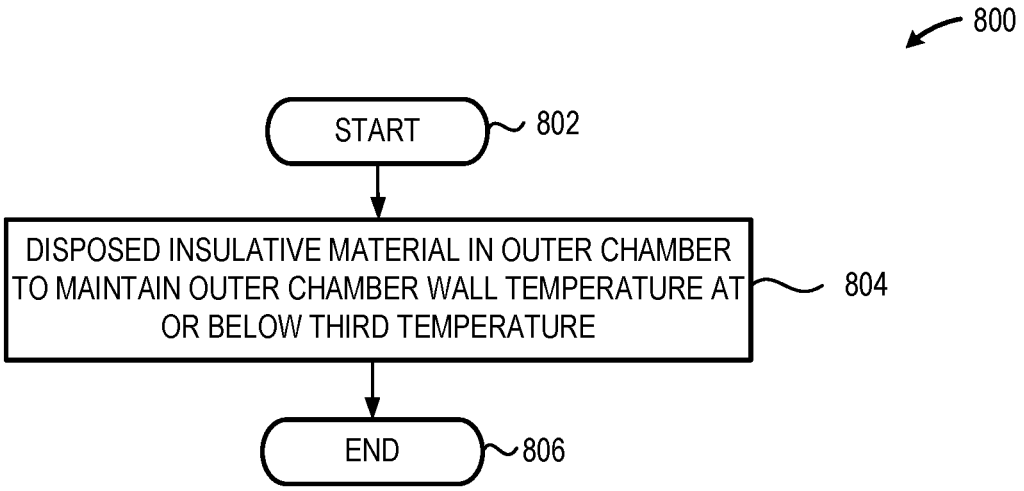
FIG. 8 is a high-level flow diagram of an illustrative method of generating shaft work using a double-wall turboexpander having an insulative material disposed in an outer chamber of the turboexpander, in accordance with at least one embodiment described herein.

FIG. 8 is a high-level flow diagram of an illustrative method 800 of generating shaft work using a double-wall turboexpander 110, in accordance with at least one embodiment described herein. The method 800 may be used in conjunction with the method 600 described in FIG. 6 above. The double-wall turboexpander 110 may include an inner chamber 112 and a close or sealed outer chamber 114 separated by an inner chamber wall 210 fabricated using a high-temperature alloy material. Disposing a thermal attenuator within the outer chamber 114 maintains the outer chamber wall 220 of the double-wall turboexpander 110 at a third temperature that is at or below the first temperature of the supercritical $CO_2$ supplied to the inner chamber 112 of the double-wall turboexpander 110. The method 800 commences at 802.

At 804, a thermal attenuator, such as one or more insulative materials, may be disposed in the outer chamber 114 of the double-wall turboexpander 110. Example insulative materials include, but are not limited to: fiberglass, mineral wool, calcium-silicate (Cal-Sil®), Aerogel, and similar. The thermal attenuator maintains the outer chamber wall 220 of the double-wall turboexpander 110 at the third temperature and a third pressure. The method 800 concludes at 804.

While FIGS. 6 through 8 illustrate various operations according to one or more embodiments, it is to be understood that not all of the operations depicted in FIGS. 6 through 8 are necessary for other embodiments. Indeed, it is fully contemplated herein that in other embodiments of the present disclosure, the operations depicted in FIGS. 6 through 8, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

Thus, the present disclosure is directed to systems and methods generating power using supercritical $CO_2$ in a Brayton cycle that incorporates a double-wall turboexpander that includes an inner chamber that houses the supercritical $CO_2$ expansion turbine and an outer chamber containing a thermal attenuator. The thermal attenuator may include a coolant flowing through the outer chamber. In other embodiments, the thermal attenuator may include one or more flexible or rigid insulative materials (e.g., fiberglass, calcium silicate, and similar). An inner chamber wall separates the inner chamber and the outer chamber within the double-wall turboexpander. In supercritical $CO_2$ applications, the double-wall turboexpander operates at elevated temperatures (e.g., 650° C.) and elevated pressures (e.g., 290 Bar). A conventional (i.e., non-double wall) turboexpander would typically be fabricated using costly high temperature alloy to accommodate the elevated operating temperature and thick walled construction to handle the elevated operating pressure. By maintaining the thermal attenuator in the outer chamber at an elevated pressure, the differential pressure across the inner chamber wall (i.e., the difference in pressure between the inner chamber and the outer chamber) is reduced, requiring less high-temperature alloy material in the construction of the double-wall turboexpander when compared to a conventional turboexpander. In addition, the thermal attenuator disposed in the outer chamber beneficially reduces the operating temperature of the outer chamber wall (the external housing) of the double-wall turboexpander. By reducing the operating temperature of the outer chamber wall, a less costly lower-temperature alloy may be used to provide structural strength to the double-wall turboexpander.

The following examples pertain to further embodiments. The following examples of the present disclosure may comprise subject material such as at least one device, a method, at least one machine-readable medium for storing instructions that when executed cause a machine to perform acts based on the method, means for performing acts based on the method and/or a system for generating a shaft work output using a double-wall turboexpander that includes an inner chamber and an outer chamber separated by an inner chamber wall. The relatively thin inner chamber wall may be fabricated using a high-temperature alloy material. The relatively thick outer chamber wall may be fabricated using a lower temperature alloy material.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A supercritical $CO_2$-based energy generation system, comprising:

a heat source to provide supercritical $CO_2$ at a first temperature T1 and a first pressure P1;

a double walled supercritical $CO_2$ turboexpander that includes:

an inner chamber housing an expansion turbine, the inner chamber to receive the supercritical $CO_2$ at the first temperature T1 and the first pressure P1 and discharge the supercritical $CO_2$ at a second temperature T2 and a second pressure P2;

a closed outer chamber at least partially surrounding the inner chamber, wherein the closed outer chamber contains a solid thermal attenuator and is configured such that a third pressure P3 within the closed outer chamber is between at or above ambient pressure and at or below P1, and the solid thermal attenuator is configured to maintain the outer chamber wall at or below a third temperature T3, wherein T3 is less than T1;

an inner chamber wall having a first thickness and which fluidly isolates the inner chamber and the outer chamber; and an outer chamber wall having a second thickness and which fluidly isolates the outer chamber from an ambient environment about the turboexpander;

a thermal energy exchanger fluidly coupled to the inner chamber to receive supercritical $CO_2$ at the second temperature T2 and the second pressure P2 and cool the supercritical $CO_2$;

a supercritical $CO_2$ compressor fluidly coupled to the thermal recovery system to receive the cooled supercritical $CO_2$, the supercritical $CO_2$ compressor to provide compressed supercritical $CO_2$ at an elevated pressure;

an energy generator operably coupled to the double walled supercritical $CO_2$ turboexpander to receive a shaft work input from the double walled supercritical $CO_2$ turboexpander;

wherein:

T2 is less than T1;

P2 is less than P1; and

T1 is less than or equal to 1000° C.;
P1 is greater than or equal to 150 Bar;
T2 is greater than or equal to 300° C.; and
P2 is less than or equal to 250 Bar.

2. The system of claim 1 wherein the solid thermal attenuator is a flexible, semi-rigid, or rigid insulator.

3. The system of claim 1 wherein the supercritical $CO_2$ compressor fluidly couples to the thermal energy exchanger such that the temperature of the supercritical $CO_2$ received from the double walled supercritical $CO_2$ turboexpander is decreased and the temperature of the compressed supercritical $CO_2$ received from the supercritical $CO_2$ compressor is increased.

4. The system of claim 1:

wherein the first thickness is determined, based at least in part, on the first temperature T1 and a first differential pressure measured transversely across the inner chamber wall, the first differential pressure measured as the difference between P1 and P3;

wherein the second thickness is determined, based at least in part, on the third temperature T3 and a second differential pressure measured transversely across the outer chamber wall, the second differential pressure measured as the difference between the P3 and an ambient pressure of an ambient environment surrounding the double walled supercritical $CO_2$ turboexpander.

5. The system of claim 4 wherein the first thickness is less than the second thickness.

6. The system of claim 5, wherein:

the first differential pressure is less than 1000 pounds per square inch gauge; and the second differential pressure is greater than 1500 pounds per square inch gauge.

7. The system of claim 6, wherein:

T1 is greater than 800° C.;
T2 is greater than 500° C.; and
T3 is less than 500° C.

8. The system of claim 1:

wherein the inner chamber wall comprises a first material selected from a nickel containing alloy, titanium, a titanium containing alloy, and a cobalt containing alloy; and wherein the outer chamber wall comprises a second material that differs from the first material, and is selected from an austenitic stainless steel, a nickel containing alloy, titanium, a titanium containing alloy, and a cobalt containing alloy.

9. The system of claim 1:

wherein the inner chamber wall comprises a wall having a first thickness of from 2 inches to 4 inches; and wherein the outer chamber wall comprises a wall having a second thickness of from 2 inches to 7 inches.

10. The system of claim 1, wherein the solid thermal attenuator comprises fiberglass, mineral wool, calcium-silicate, aerogel, or a combination of two or more thereof.

11. A method for expanding supercritical $CO_2$ to produce shaft work using a double-wall turboexpander, the method comprising:

flowing supercritical $CO_2$ at a first temperature T1 and a first pressure P1 through a continuous, fluid-tight, inner chamber that includes a supercritical $CO_2$ expansion turbine;

removing the supercritical $CO_2$ at a second temperature T2 and a second pressure P2 from the inner chamber; wherein:

T2 is less than T1;
P2 is less than P1;
T1 is less than or equal to 1000° C.;
P1 is greater than or equal to 150 Bar;
T2 is greater than or equal to 300° C.; and
P2 is less than or equal to 250 Bar;

contemporaneous with flowing the supercritical $CO_2$ at the first temperature T1 and the first pressure P1 through the continuous, fluid-tight, inner chamber, attenuating at least a portion of the thermal energy from the supercritical $CO_2$ such that:

an outer chamber wall of a closed outer chamber is maintained at or below a third temperature T3, wherein T3 is less than T1 the third temperature is less than the first temperature; and a pressure P3 of the closed outer chamber is between at or above ambient pressure and at or below P1; and wherein at least a portion of the inner chamber and at least portion of the closed outer chamber are formed by opposite sides of an inner chamber wall that includes a first material having a first thickness selected based, at least in part, on T1;

wherein the outer chamber wall includes a second material having a second thickness that is selected based, at least in part, on T3; and wherein the closed outer chamber comprises a solid thermal attenuator.

12. The method of claim 11 wherein the solid thermal attenuator is a flexible, semi-rigid, or rigid insulator.

13. The method of claim 11 wherein:

the first thickness is selected based, at least in part, on T1 and a first differential pressure measured transversely across the inner chamber wall; and the first differential pressure is a difference between P1 and P3.

14. The method of claim 13 wherein:

the second thickness is selected based, at least in part, on T3 and a second differential pressure measured transversely across the outer chamber wall; and the second differential pressure is a difference between P3 and an ambient pressure surrounding the double-wall turboexpander.

15. The method of claim 13, wherein the first differential pressure is less than 1000 pounds per square inch gauge.

16. The method of claim 14, wherein the second differential pressure is greater than 1500 pounds per square inch gauge.

17. The method of claim 14 wherein: the first thickness ranges from about 2 inches to about 4 inches; and the second thickness ranges from about 2 inches to about 7 inches.

18. The method of claim 11, wherein the solid thermal attenuator comprises fiberglass, mineral wool, calcium-silicate, aerogel, or a combination of two or more thereof.

19. A double-wall turboexpander, comprising:

an expansion turbine disposed in a continuous, fluid-tight, inner chamber, the inner chamber to:

receive supercritical $CO_2$ at a first temperature T1 and a first pressure P1; and discharge supercritical $CO_2$ at a second temperature T2 and a second pressure P2, wherein T2 is less than T1; and
P2 is less than P1;
T1 is less than or equal to 1000° C.;
P1 is greater than or equal to 150 Bar; and
T2 is greater than or equal to 300° C.;

an inner chamber wall forming at least a portion of the perimeter of the continuous, fluid-tight, inner chamber;

wherein the inner chamber wall includes a first material having a first thickness selected based, at least in part, on T1;

an outer chamber wall spaced apart from the inner chamber wall to form a closed outer chamber between the inner chamber wall and the outer chamber wall forming at least a portion of the double-wall turboexpander, the closed outer chamber to:

attenuate at least a portion of the thermal energy from the supercritical $CO_2$ sufficient to maintain the outer chamber wall of the closed outer chamber at or below a third temperature T3; with a pressure P3 of the closed outer chamber between at or above ambient pressure and at or below P1;

wherein the outer chamber wall includes a second material having a second thickness selected, based at least in part, on T3, and the closed outer chamber comprises a solid thermal attenuator.

20. The double-wall turboexpander of claim 19, wherein the solid thermal attenuator comprises fiberglass, mineral wool, calcium-silicate, aerogel, or a combination of two or more thereof.

* * * * *